United States Patent [19]

Labrecque

[11] Patent Number: 5,044,241

[45] Date of Patent: Sep. 3, 1991

[54] CUTTING APPARATUS FOR WRAP FILM

[76] Inventor: Normand F. Labrecque, 392, rue du Cap, St-Bernard, Quebec, Canada, G0S 2G0

[21] Appl. No.: 496,346

[22] Filed: Mar. 20, 1990

[51] Int. Cl.[5] ..... B26D 1/18

[52] U.S. Cl. ..... 83/489; 83/614; 83/649

[58] Field of Search ..... 83/471.2, 614, 649, 83/485, 487, 488, 489

[56] References Cited

U.S. PATENT DOCUMENTS

| | | | |
|---|---|---|---|
| 2,746,545 | 5/1956 | Chamberlain | 83/489 |
| 2,765,037 | 10/1956 | McDonough et al. | 83/489 |
| 2,987,864 | 6/1961 | Miller | 83/649 X |
| 3,142,217 | 7/1964 | Busse | 83/649 X |
| 3,199,394 | 8/1965 | Castelli | 83/614 X |
| 3,240,093 | 3/1966 | Bell, Jr. et al. | 83/649 X |
| 3,648,557 | 3/1972 | Lind | 83/489 |
| 3,821,915 | 7/1974 | Larrable | 83/649 X |
| 3,919,905 | 11/1975 | Hoffman | 83/205 |
| 3,984,211 | 10/1976 | Hawkins | 83/488 X |
| 4,417,495 | 11/1983 | Gordon et al. | 83/649 X |
| 4,691,605 | 9/1987 | Vanetik et al. | 83/488 X |
| 4,754,674 | 7/1988 | Perlman | 83/649 X |

*Primary Examiner*—Douglas D. Watts
*Assistant Examiner*—Eugenia A. Jones
*Attorney, Agent, or Firm*—Roland L. Morneau

[57] ABSTRACT

A cutting apparatus for wrap film is made of a housing for supporting a roll of paper or plastic film and an apron for supporting the leading edge portion of the film. A cutting assembly is mounted over the apron and is slidingly mounted along the housing to cut the leading edge. The cutting assembly includes a circular cutting wheel and a driving mechanism for rotating the wheel at a peripheral speed greater than the linear speed of the cutting assembly.

1 Claim, 5 Drawing Sheets

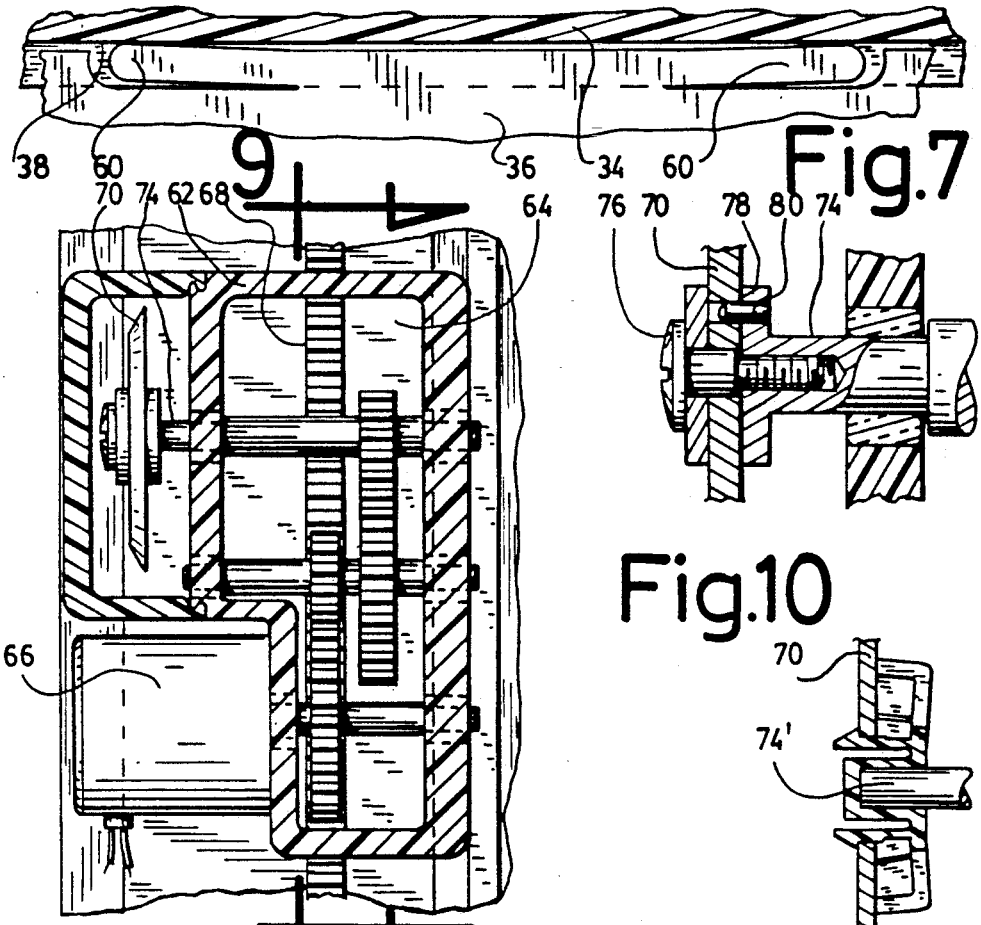
Fig.7
Fig.8
Fig.10
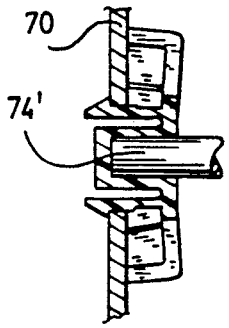
Fig.11
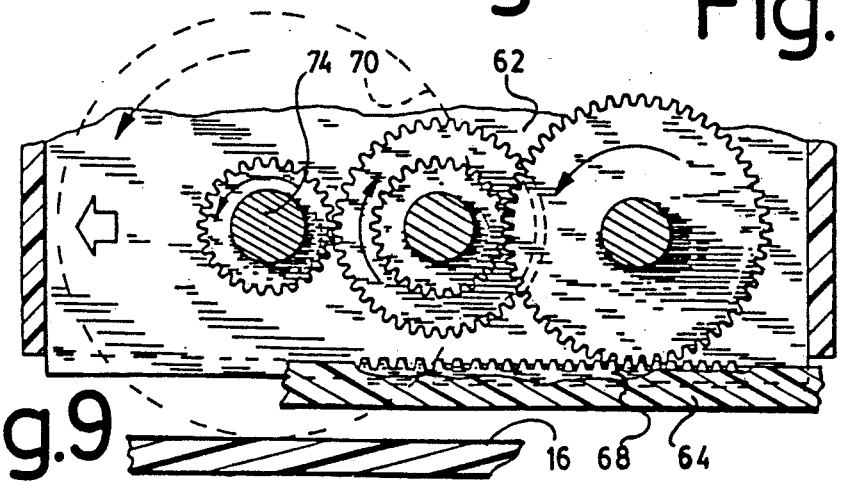
Fig.9

CUTTING APPARATUS FOR WRAP FILM

BACKGROUND OF THE INVENTION

1. Field of the Invention

This application relates to an apparatus for wrap film of plastic or paper and the like using a rotary circular cutter moving across the width of the film at a linear speed slower than the peripheral speed of the circular cutter. The wheel of the cutter is rotated by an electric motor, a crown and pinion combination or a fixed string frictionally encircling a linearly moving shaft supporting the circular cutter.

2. Prior Art

An investigation among prior art has revealed the following patents describing sliding cutters for rolls of paper, plastic and aluminium films or cardboards:

| U.S. Pat. Nos. | |
|---|---|
| 3,071,034 | 3,142,217 |
| 3,199,394 | 3,688,625 |
| 4,197,774 | 4,787,284 |

All these cutters are knife assemblies characterized by one or more razor blades generally making use of a sharp, piercing corner of the blades. The action of the blade is limited to sliding movement across the roll.

SUMMARY OF THE INVENTION

A cutting apparatus for wrap film uses a rotating cutting assembly sliding across the width of the film at a linear speed slower than the peripheral or tangential speed of the wheel. The rotation of the wheel is preferably actuated by the sliding movement of the assembly.

BRIEF DESCRIPTION OF THE DRAWINGS

FIG. 7 is a cross-sectional view along line 7—7 of FIG. 4;

FIG. 8 is a cross-sectional view of a wheel driving assembly according to a different embodiment different than the one shown in FIG. 5;

FIG. 9 is a cross-sectional view of the latter embodiment along line 9—9 of FIG. 8;

FIG. 10 is a cross-sectional view of a means for securing the cutting wheel;

FIG. 11 is a cross-sectional view of an alternative means for securing the cutting wheel;

DETAILED DESCRIPTION OF THE INVENTION

Figure 1:
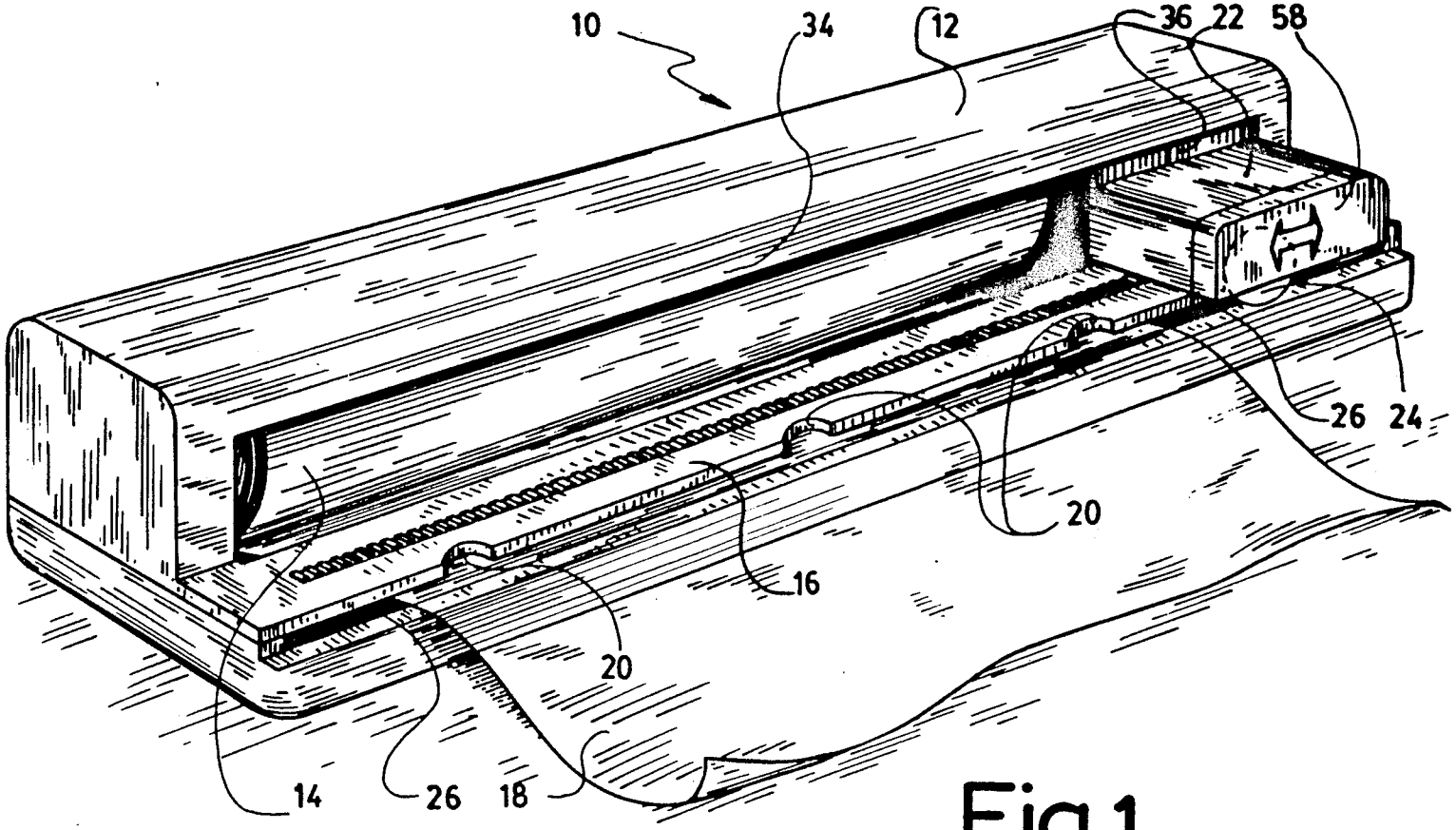
FIG. 1 is a perspective view of a cutting apparatus according to an embodiment of the invention.
Figure 2:
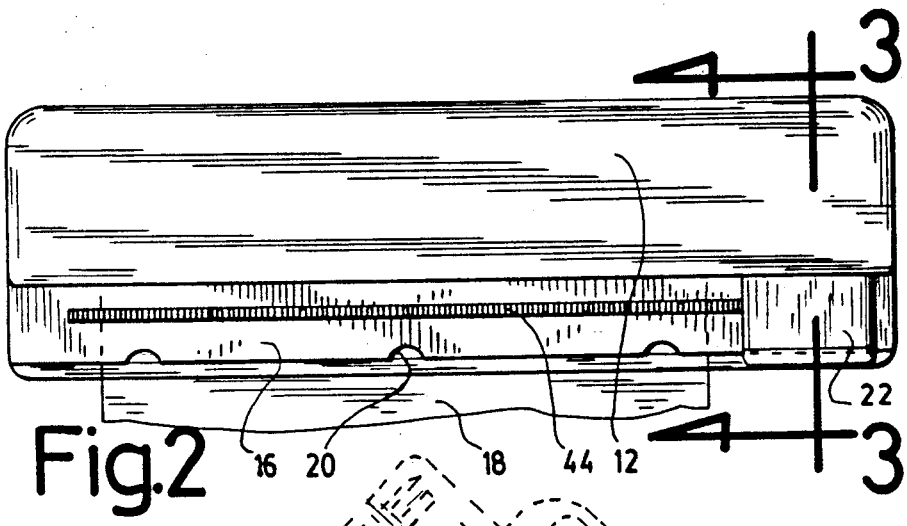
FIG. 2 is a top view of the cutting apparatus shown in FIG. 1.

FIG. 1 illustrates an embodiment of the cutting apparatus according to the invention. It is constituted of a housing 12 containing a wrap film 14 adapted to be pulled in front of the housing 12 on an apron 16. The leading edge 18 of the film 14 is initially retracted from the apron by the fingers adapted to be inserted in the indentation 20. A carriage 22 is slidably mounted over the apron 16. A cutting wheel 24 is mounted in the carriage 22. The cutting wheel 24 is located over a longitudinal path 26 so as to pass over the leading edge 18 when the latter is pulled out of the housing 12. When the carriage 22 is slidably moved over the apron 16, the wheel 24 is rotatingly actuated in such a way, so that its peripheral speed is faster than the linear speed of the carriage over the groove 26. The leading edge 18 preferably slides between two solid surfaces of the apron 16.

Figure 3:
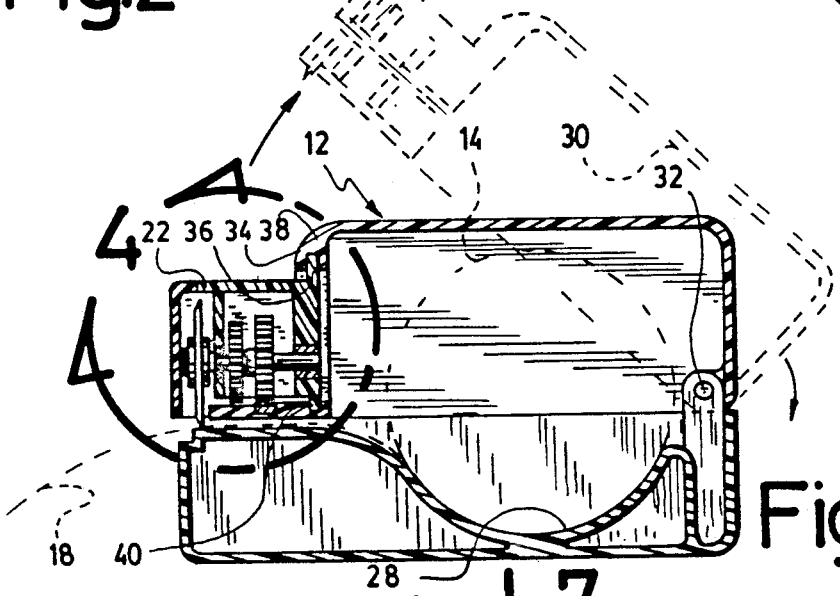
FIG. 3 is a cross-sectional view along line 3—3 of FIG. 2.
Figure 4:
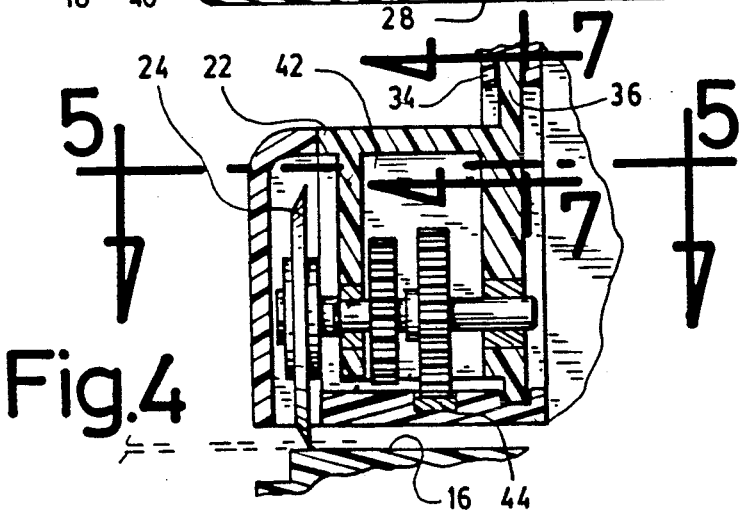
FIG. 4 is an enlarged view of encircled portion 4 of FIG. 3.
Figure 5:
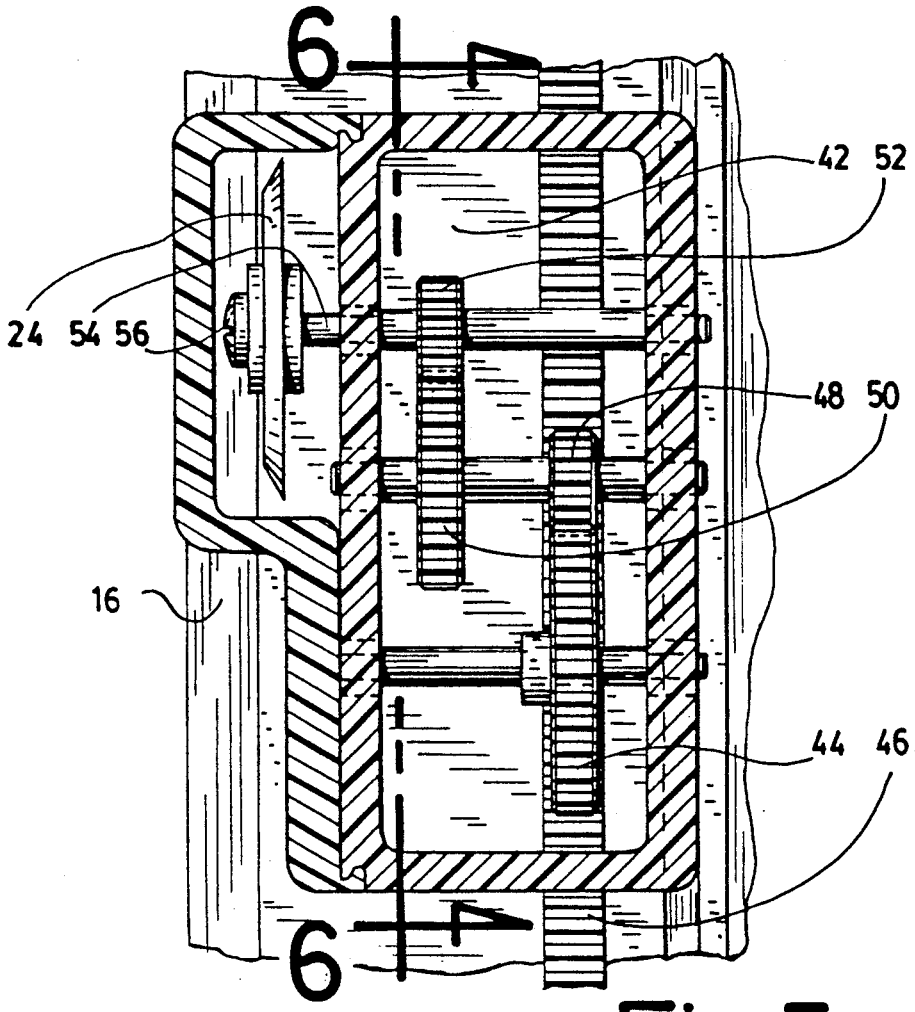
FIG. 5 is a cross-sectional view of the wheel driving assembly along line 5—5 of FIG. 4.
Figure 6:
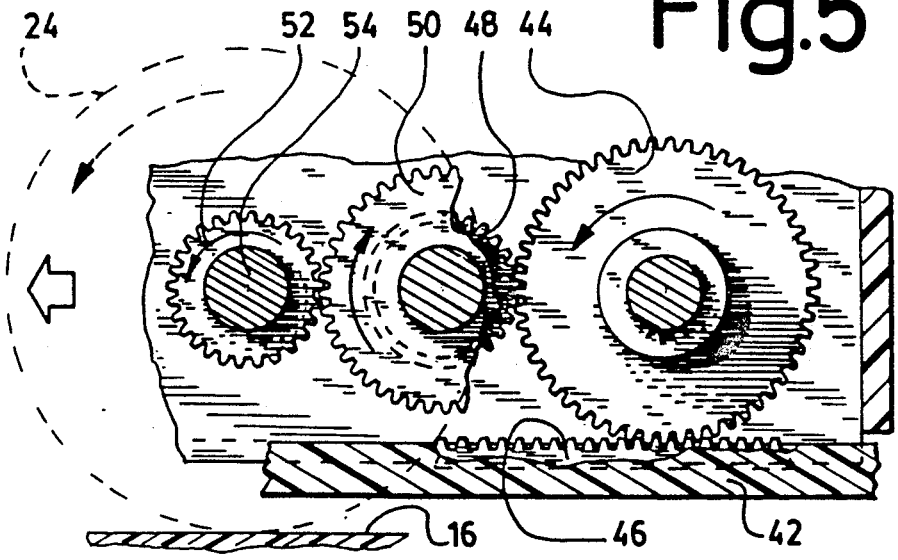
FIG. 6 is a cross-sectional view along line 6—6 of FIG. 5.

As shown in FIG. 3, the wrap film 14, which has a cylindrical shape, is freely supported in a concave tray 28. The housing 12 has a cover 30 which is hingedly pivoted about the axle 32. When the cover is in its open position, as shown in dotted line in FIG. 3, the complete wrap film 14 can be inserted or withdrawn from the housing 12.

The housing 12 is provided with a front panel 34 which holds a ledge 36 of the carriage 22. The ledge 36 runs into an upper groove 38 to allow the carriage 22 to move across the front of the housing 12. The housig 22, also, has a lower ledge 40, which slides in a lower groove for supporting the weight of the carriage 22. The upper and lower grooves constitute a riding track for the carriage 22.

The carriage 22 contains a gear box 42 made of a plurality of toothed wheels adapted to rotate the cutting wheel 24. The leading toothed wheel 44, when slidden over the apron 16, engages the toothed rack 46 which produces a rotation of the other toothed wheels, such as 48, 50 and 52. The toothed wheel 52 is mounted on an axle 54 on which is secured the cutting wheel 24. The cutting wheel 24 can be changed whenever it becomes dull, by removing the screw 56 through the cover 58 of the carriage 22. The gear box 42 is adjusted to provide the cutting wheel 24 with a peripheral speed which is, at all times, faster than the linear speed of the carriage 22. It has been found that a ratio of 4 to 6 is preferred and that a ratio above 10 may be superfluous in speed.

As particularly seen in FIG. 1, the carriage 22 is positioned at the end of the wrap film 14 outside its width. The track 46 extends the full width of the housing 12 so that when the carriage, and in particular, the cutting wheel 24 reaches the side of the leading edge 18 of the wrap film, it has already reached the predetermined rotating speed. The housing 12 is also sufficiently long to allow the cutting wheel 24 to fully cross the leading edge 18 before the cutting wheel 24 comes to a stop. Accordingly, the full width of the wrap film will be cut by the rotating wheel 24 which has a peripheral speed greater than the linear speed of the carriage 22. The rotation of the cutting wheel 24 constitutes an essential difference with the use of a razor blade, as explained above in the prior art section.

FIG. 7 illustrates one embodiment of the upper edge 36 which slides in the groove 38 of the front panel 34. In order to provide a smoother movement of the carriage 22, a portion of the upper ledge 36 is provided with two tongues 60 which are adapted to provide a resilient friction in the groove 38 behind the front panel 34. This resilient friction is obtained by cutting the tongues 60 from the ledge 36 and bending the tongues outwardly so that only the outer tip of the tongues 60 provide the desired resilient friction during the sliding movement of the carriage 22.

FIG. 8 illustrates a different embodiment of the carriage 62 which is also provided with a gear box 64. The gear box 64 is actuated by a small D.C. motor 66 which is adapted to be operated by a switch on the carriage 62. When the switch is actuated, the motor starts to operate the gear box 64 which, in turns, moves the carriage 62 over the toothed rack 68 by the engagement of a leading gear with the rack 68. While the carriage 62 is moving longitudinally in front of the housing of the cutting apparatus, the wheel 70 is rotated at the desired speed over the leading edge of the wrap film. With this arrangement, no hands are used during the cutting operation except at the moment the switch is actuated. This allows the operator to use both hands for manipulating the leading edge of the wrap film.

FIG. 10 shows one embodiment for supporting the cutting wheel 70 over the axle 74. A screw 76 is engaged through the middle of the cutting wheel 70 and is fixed inside the center of the axle 74. The latter is provided with an abutting surface 78 for firmly supporting the wheel 70. In order to prevent the cutting wheel 70 from rotating in its socket, a pin 80 extends through the abutting surface 78 and through the wheel 70.

Figure 12:
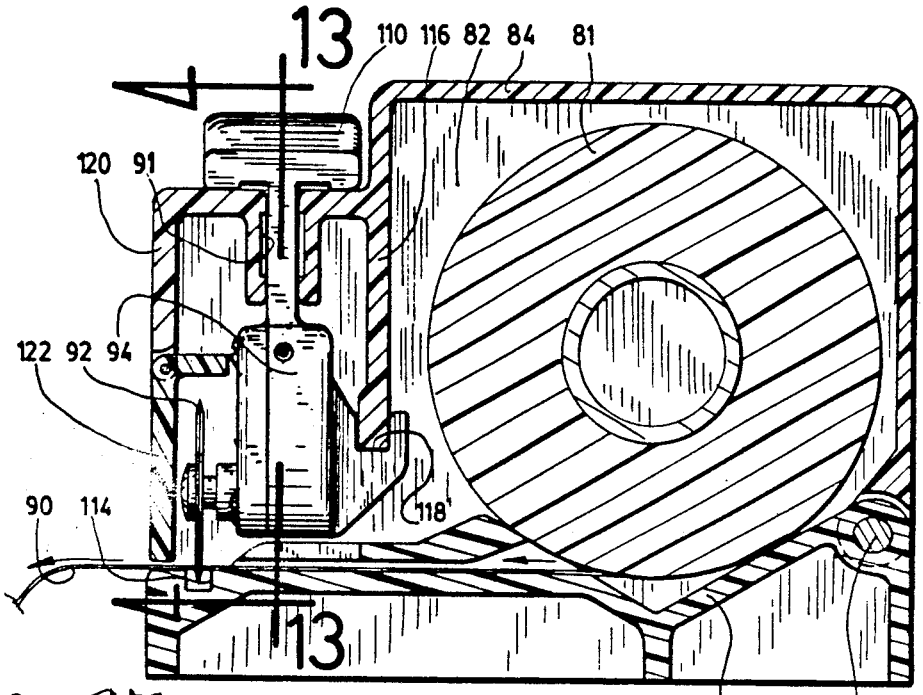
FIG. 12 is a cross-sectional view corresponding to FIG. 3 relative to a different embodiment of the invention.

FIG. 12 illustrates another embodiment of the invention wherein, a wrap film 81 is disposed in a housing 82 provided with a cover 84 adapted to pivot around the axle 86. The wrap film 80 is supported by the tray 88 and its leading edge 90 extends outside the housing 82. The upper front part of the housing 82 is provided with a slot 91 across the length of the housing and is adapted to guide a mechanism 94 suitable for rotating the cutting wheel 92.

Figure 13:
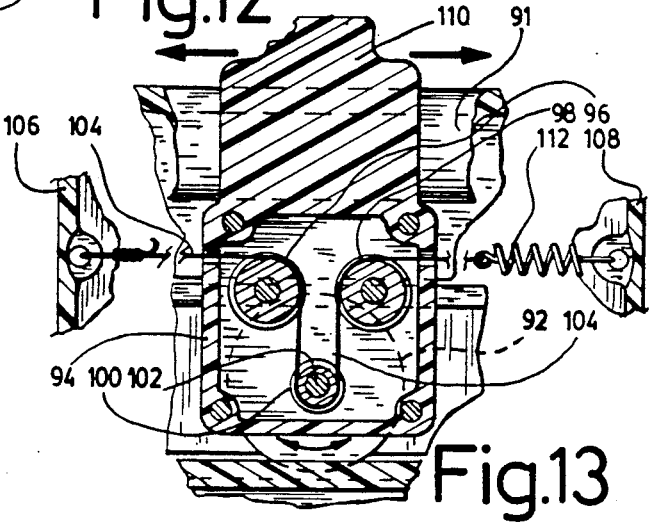

FIG. 13 shows in cross-section, the mechanism 94 which contains two pulleys 96 and 98 and a wheel 100 carrying a shaft 102 on which the cutting wheel 92 is mounted. A string 104 which is secured at both ends 106 and 108 of the housing 82 passes over the pulleys 96 and 98 and under the wheel 100. The mechanism 94 is supported by a knob 110 extending through the slot 90. By manually moving the knob 110 along the slot 91, the movement of the mechanism 94 over the string 104 will create a rotation of the shaft 102 and of the cutting wheel 92. In order to provide smoothness in the reaction of the mechanism over the string 104, a coil spring 112 is secured between the string 104 and one of the ends 106 or 108. The speed of rotation of the cutting wheel 92 is proportional to the relative diameter between the wheel 100 and the diameter of the cutting wheel 92. This proportion can be maintained within the predetermined speed limits stated above.

The cutting wheel 92 extends through the groove 114 and in its rotation, will cut the leading edge 90. The periphery of the wheel 92 remains distant from the bottom of the groove 114 and contiguous with the lateral wall.

The knob 110 prevents a downward motion of the mechanism 94 and a partition 116 extending from the cover 84 downwardly into a groove 118 of the partition 116 prevents an upward movement of the same mechanism. A smooth linear movement is accordingly provided to the mechanism which is an alternative embodiment of carriage 22.

Figure 12A:
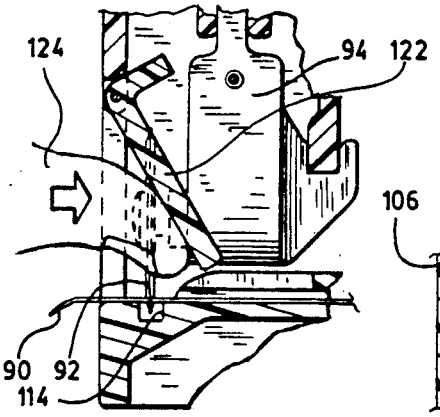
FIG. 12*a* illustrates a portion of FIG. 12 with the suspended hinged door slightly opened; and, FIG. 13 is a cross-sectional view taken along line 13—13 of FIG. 12.

The forward panel 120 of the housing 82 is provided with a hinged door 122 which extends across the full width of the wrap film 80. When the mechanism 94 is laterally pushed away from the width of the wrap film 80, the door 122 can be pushed with the finger 124 as shown in FIG. 12*a* to have access to the leading edge 90 of the film and also to be able to observe the quantity of film remaining in the housing 82. This hinge cover 122 constitutes a security device when the mechanism 94 is moved across the width of the wrap film 80. As it can be seen from FIG. 12, the hinged door 122 can not be pushed in when the cutting wheel 92 is facing the door 122. Accordingly, no finger or foreign matter can come in touch with the rotating cutting wheel 92.

The thickness of the cutting wheel such as 24, 70 or 92 is about the same as a razor blade but it can be realized that the cutting surface is much longer than when only one corner of a razor blade is used for cutting the wrap film. Such a thickness is approximately 0.01 inch. The optimum diameter of cutting wheel has been found to be about 1 inch, although cutting wheels of $\frac{1}{4}$ to $\frac{1}{2}$ inch or successful.

The cutting operation can equally perform in both longitudinal directions of the carriage 22 or of the mechanism 94.

The cutting edge of the cutting wheel, according to the invention, has preferably a continuous and uniform edge but a saw type edge can also perform according to the invention. The housing, according to the invention is preferably made of a plastic on which the wrap film slightly adheres to so that the operator may leave the leading edge over the apron 16, while the rotating cutting wheel moves over the film without affecting its position. The cut is easy, quick and clean.

In the embodiments described, the roll wrap paper is supported on a tray without an axial support. However, it has been found that when the roll is heavy, such as for commercial use, an axial support for the roll of wrap film is preferred.

The present cutting apparatus can be used equally well by a right-handed or a left-handed person.

I claim:

1. A cutting apparatus for wrap film of paper and plastic comprising:

an elongated dispenser housing having a concave tray for freely supporting a roll of wrap film and a cover hingedly fixed to said tray along an axis parallel to said roll and rearwardly thereof, said cover adapted to hide said roll in a closed position and completely expose it in its opened position, said tray extending forwardly to form an apron for supporting a leading edge portion of said wrap film, said housing displaying a slot extending lengthwise between said apron and said cover to allow said film to exit from said housing, said cover having a forward open panel displaying a rectangular opening, said opening having a bordering ledge forming a track in front of said roll and extending sideways beyond said roll, a carriage slidably mounted on said track for travelling over said apron lengthwise relative to said track across and beyond said roll, a cutting wheel rotatably mounted inside said carriage over said apron to rotatably ride on the latter upon movement of said carriage, means in said carriage for rotating said wheel on said apron at a peripheral speed faster than the linear displacement of said carriage, said leading edge portion adapted to be cut by said cutting wheel along said apron upon displacement of said carriage along said track, said housing being provided with an enclosure extending in front of said opening for covering said carriage and the cutting wheel along a distance corresponding to the travelling path of the carriage, said enclosure having a pending door pivotally suspended in front of said enclosure and dimensioned in length to correspond to the length of the roll, said door adapted to exclusively swing inside the enclosure, said door extending in front and parallel to said travelling path and adjacent said cutting wheel, whereby the pivoting action of said door is hindered when the carriage is located in front of the door and is free to pivot inside said enclosure when the carriage is located beyond the length of said roll.

* * * * *